US006747225B1

(12) United States Patent
Yu

(10) Patent No.: US 6,747,225 B1
(45) Date of Patent: Jun. 8, 2004

(54) SAFETY SWITCH

(76) Inventor: Tsung-Mou Yu, 4F, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/678,323

(22) Filed: Oct. 3, 2003

(51) Int. Cl.[7] ..... H01H 13/14

(52) U.S. Cl. ..... 200/334; 200/520; 200/523; 200/528; 337/68

(58) Field of Search ..... 200/520, 523–528, 200/334, 341; 337/66, 68, 347

(56) References Cited

U.S. PATENT DOCUMENTS 3,686,601 A * 8/1972 Kaczmarek et al. ..... 337/66
4,682,138 A * 7/1987 Sell ..... 337/68
6,377,159 B1 * 4/2002 Yu ..... 337/37
6,552,643 B2 * 4/2003 Chen ..... 337/66
6,621,028 B1 * 9/2003 Bartok ..... 200/529

* cited by examiner

*Primary Examiner*—Michael A. Friedhofer

(57) ABSTRACT

A safety switch includes a base having two terminals connected thereto and each terminal has a first contact point and a bimetallic plate is movably received in the base and has two second contact points which are located above the two first contact points. The two ends of the bimetallic plate can be bent when overflow. A first spring is biased between an inside of the base and the bimetallic plate. A button assembly is connected to the base and a second spring is biased between the button assembly and the bimetallic plate. The two ends of the bimetallic plate bend upward to cut off the circuit when current overflows.

3 Claims, 5 Drawing Sheets

SAFETY SWITCH

FIELD OF THE INVENTION

The present invention relates to a switch that cuts the circuit by using a bimetallic plate when overload and no fuse or breaker is required.

BACKGROUND OF THE INVENTION

A conventional switch known to applicant is disclosed in FIGS. 1 and 2 and generally includes a base 1 with two terminals 7 and a conductive plate 27. The two terminals 7 each have a first contact point 9 and the conductive plate 27 has two second contact points 271 which are lowered to contact the first contact points 9 by pushing a button assembly 25. A first spring 11 is biased between the inside of the base 1 and the conductive plate 27 and a second spring 23 is biased between the button assembly 25 and the conductive plate 27, wherein the first spring 11 has a larger spring force than the second spring 23 so that the conductive plate 27 is located at a position as shown in FIG. 1. When pushing the button 252 of the button assembly 25, the conductive plate 27 is lowered and the second contact points 271 contact the first contact points 9 as shown in FIG. 2. The conductive plate 27 is raised by the first spring 11 when the button 252 is pushed again and released by the operation of the mechanism of the button assembly 25. This switch cannot respond when the current overflows so that many safety switches are developed, such as U.S. Pat. Nos. 5,786,742, 5,223,813, 4,937,548, 4,661,667, 5,223,813, 4,931,762, 5,451,729, and 4,704,594. A common shortcoming of the safety switches is that there is a complicated mechanism involved in each base and most of them is suffered by a problem of delay response.

Therefore, it is desired to have a safety switch that requires only a simple structure which responses the current overflow so as to cut off the circuit.

SUMMARY OF THE INVENTION

In accordance with an aspect of the present invention, there is provided a safety switch that comprises a base having two terminals and each terminal has a first contact point. A bimetallic plate is movably received in the base and two second contact points are connected to two ends of the bimetallic plate. The two second contact points are located above the two first contact points and the two ends of the bimetallic plate can be bent when overflow. A first spring is biased between an inside of the base and the bimetallic plate. A button assembly is connected to the base and a second spring is biased between the button assembly and the bimetallic plate. The two second contact points on the metallic plate are removed from the first contact points when the metallic plate is bent.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
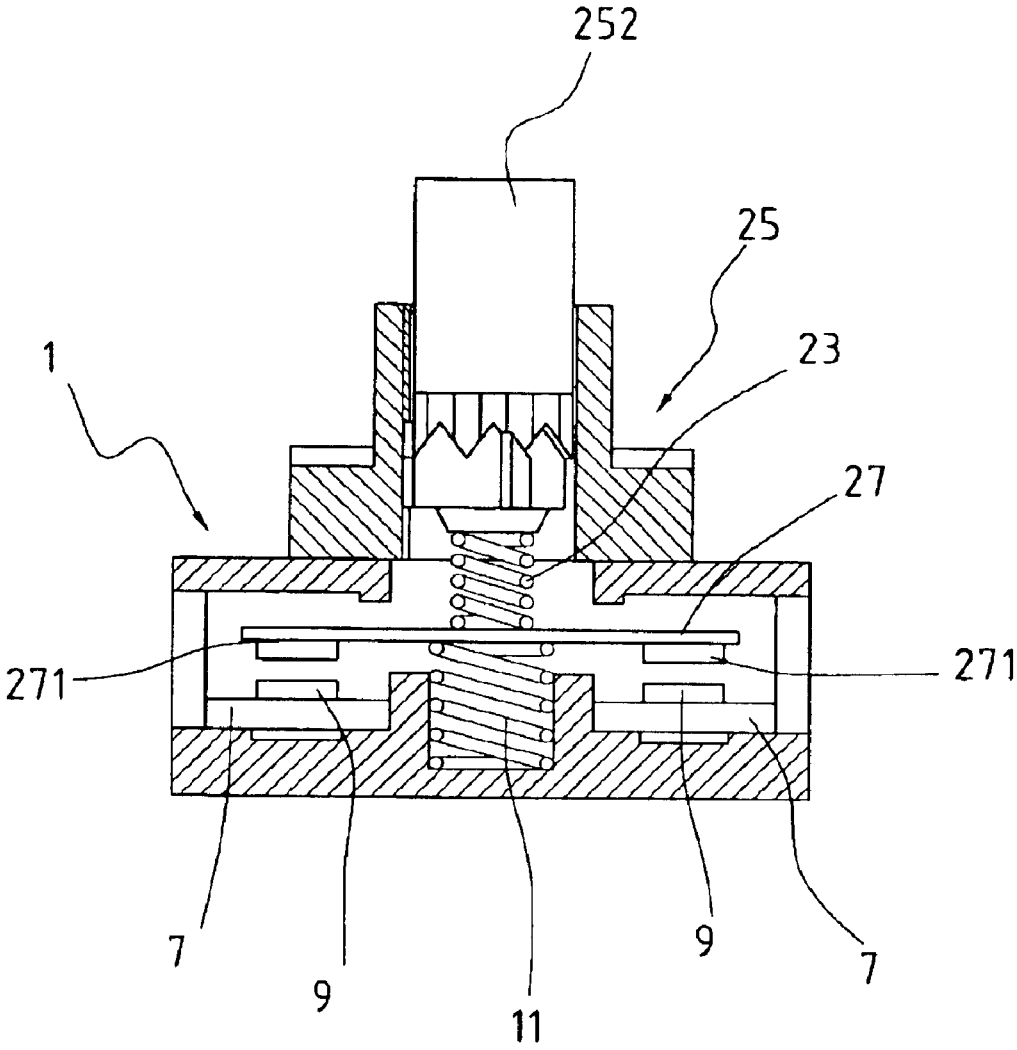
FIG. 1 PRIOR ART
FIG. 1 is a cross-sectional view of a conventional switch.
Figure 2:
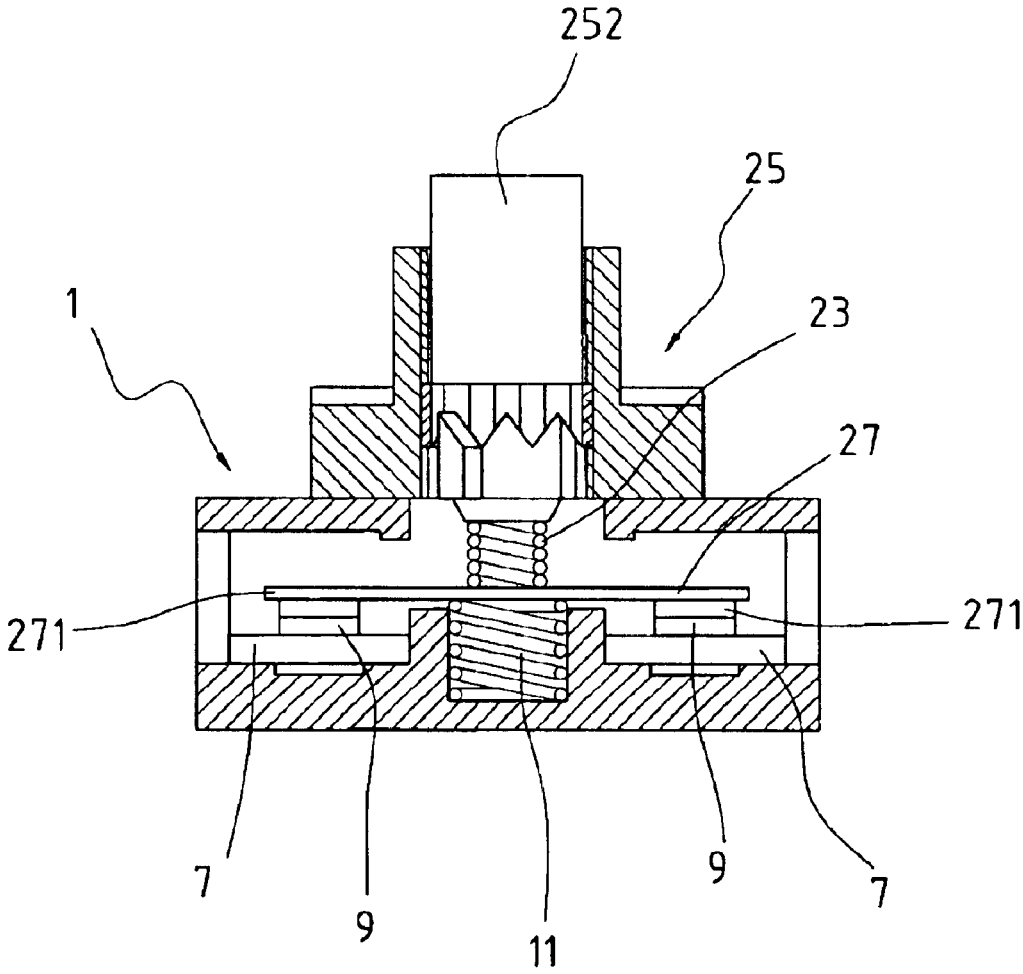
FIG. 2 PRIOR ART
FIG. 2 is a cross-sectional view of the conventional switch wherein the button is pushed to bring the second contact points to contact the first contact points.
Figure 3:
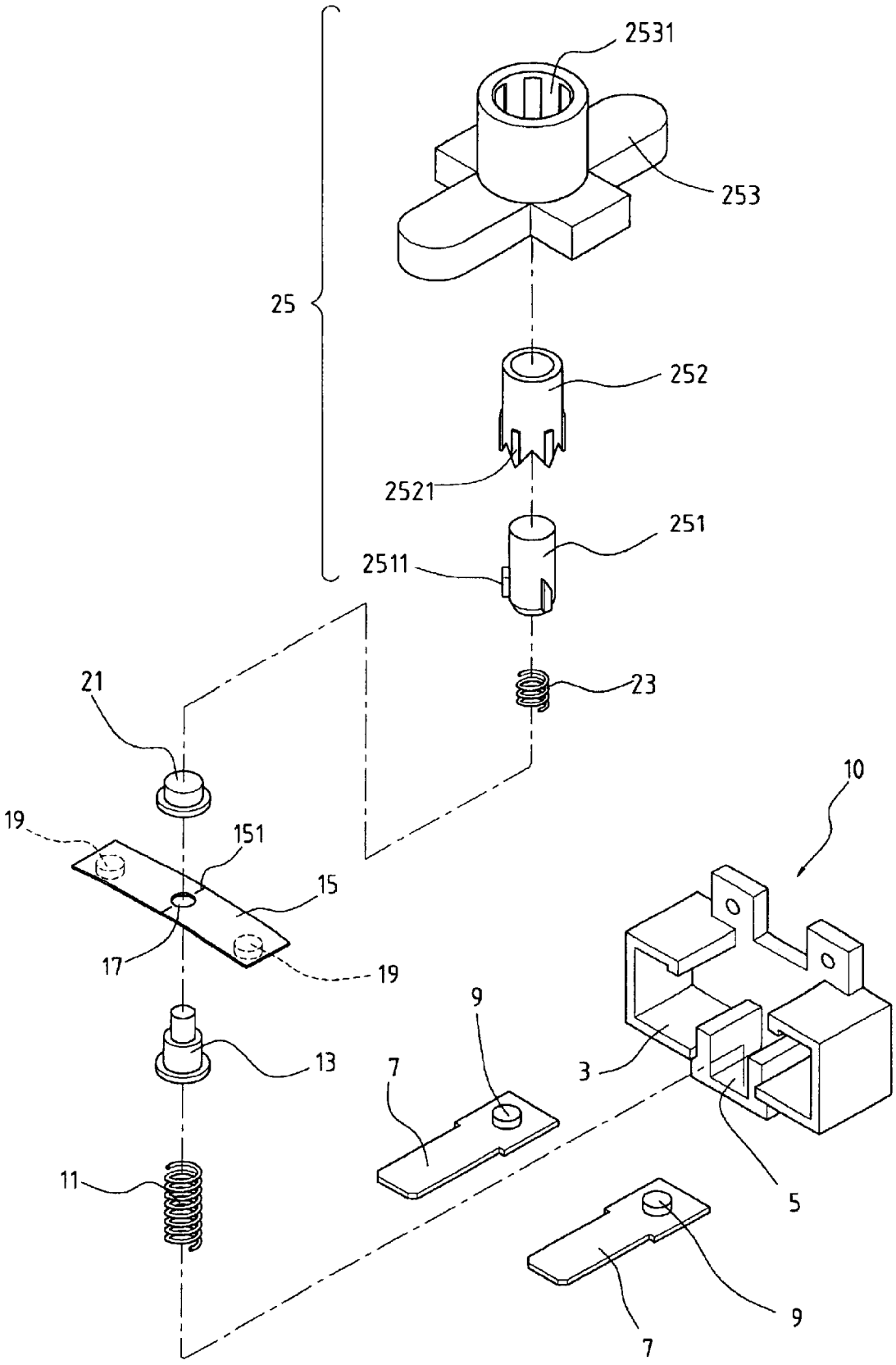
FIG. 3 is an exploded view to show a safety switch in accordance with the present invention.
Figure 4:
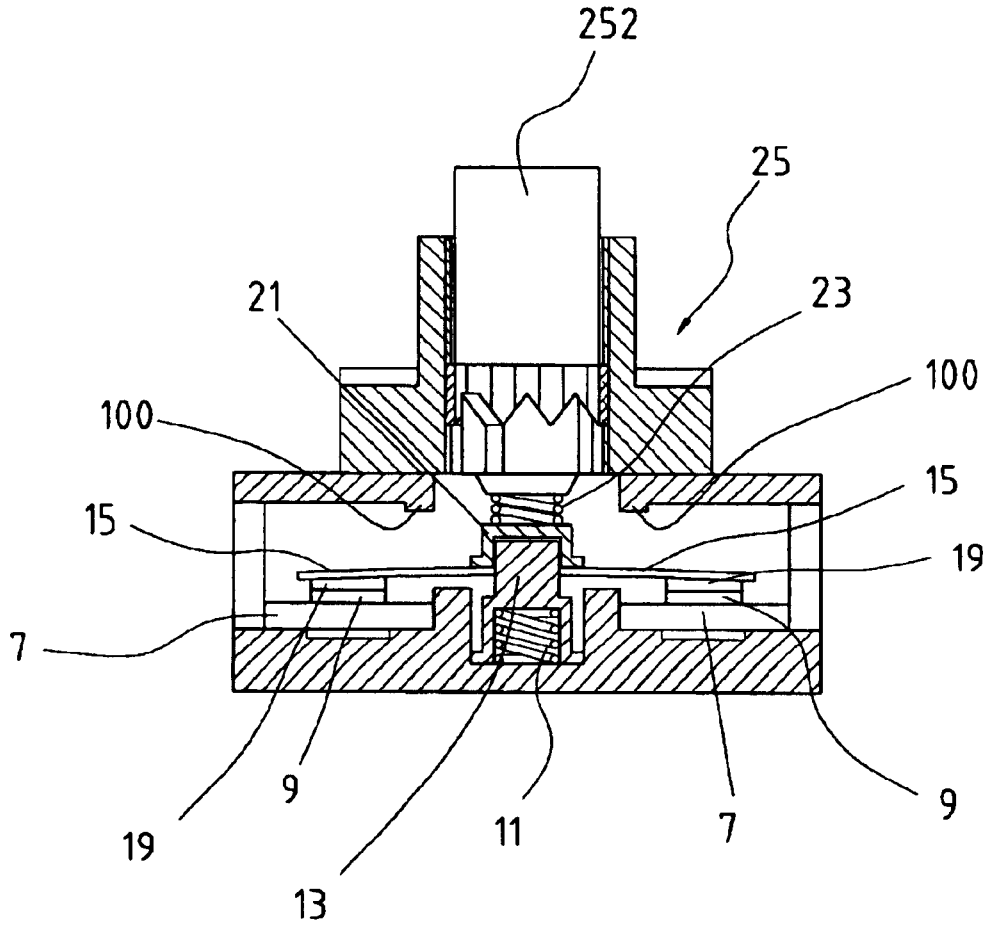
FIG. 4 shows that a button of the safety switch of the present invention is pushed to bring second contact points to contact first contact points.

Referring to the drawings and in particular FIGS. 3 and 4, a safety switch of the present invention comprises a base 10 having two chambers 3 for receiving two terminals 7 respectively and each terminal 7 has a first contact point 9. A first spring 11 is rested in a recess 5 located between the two chambers 3 and a lower end of a support post 13 is biased by the first spring 11. A bimetallic plate 15 has a hole 17 defined through a center thereof and a top end of the support post 13 extends through the hole 17 and is connected to a cap 21. Two second contact points 19 are connected to two ends of the bimetallic plate 15 and the two second contact points 19 are located above the two first contact points 9. The bimetallic plate 15 includes a bending line 151 at the center thereof so that the two ends of the bimetallic plate 15 may bend when overflow.

A button assembly 25 is connected to a top of the base 10 and a second spring 23 is biased between the button assembly 25 and the bimetallic plate 15. The button assembly 25 includes a main body 253 which has a passage defined therein and the passage has a plurality of longitudinal grooves 2531 defined in an inner periphery thereof. A button 252 is movably inserted in the passage and has several triangular protrusions extending from a lower end thereof. Each triangular protrusion includes a stop 2521 on an outside thereof. A core piece 251 has a top end inserted in the open bottom of the button 252 and has several ridges 2511 on an outer periphery thereof. Each ridge 2511 has an inclined surface which contacts a side of the corresponding triangular protrusion of the button 252. The lower end of the core piece 251 contacts the second spring 23 so that when pushing the button 252 downward, the bimetallic plate 15 is brought to let the second contact points 19 contact the first contact points 9 as shown in FIG. 4. Pushing the button 252 again, the bimetallic plate 15 is brought by the second spring 23 and the button 252 goes up to its original position.

Figure 5:
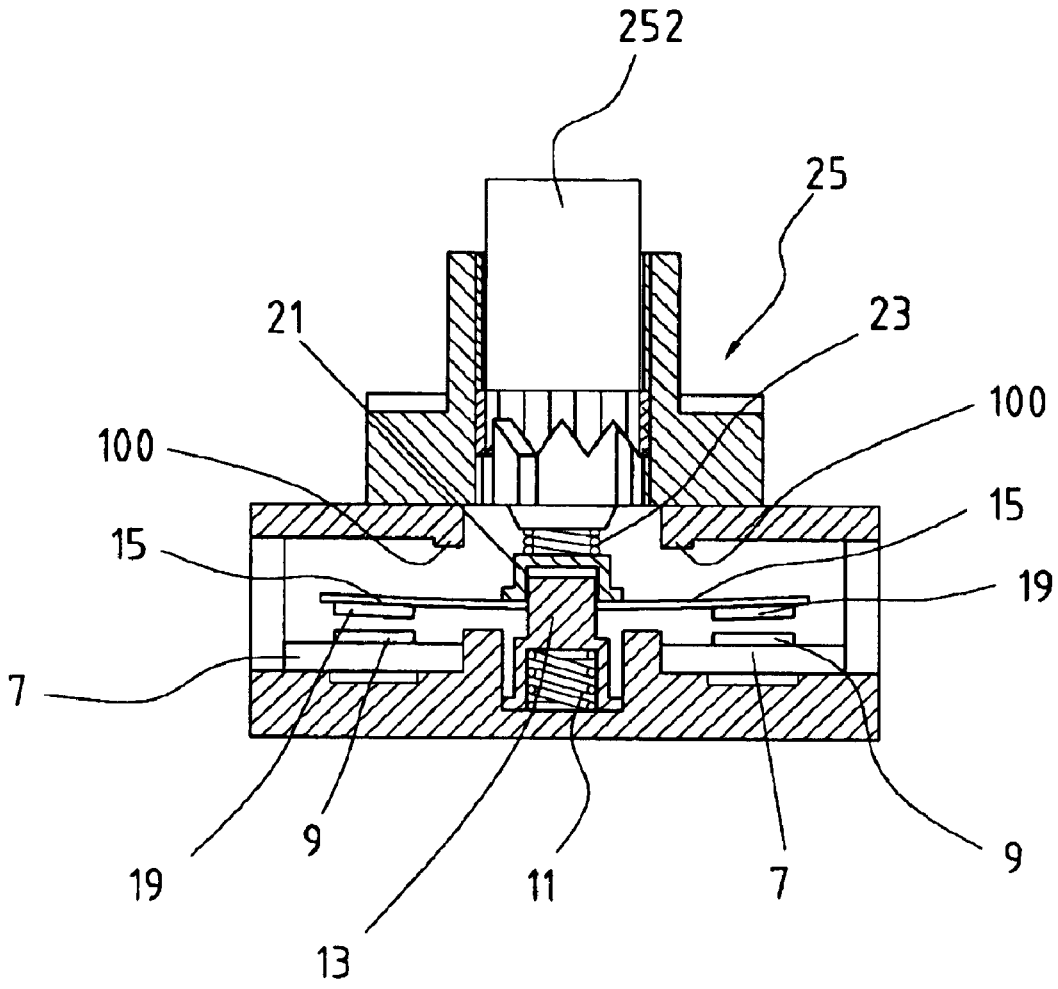
FIG. 5 shows that two ends of a metallic plate are deformed when the current overflows.

As shown in FIG. 5, when overflow, the two ends of the bimetallic plate 15 is deformed upward about the bending line 151 and the second contact points 19 are disengaged from the first contact points 9 so as to cut off the circuit and protect the switch from being burned. If the button 252 is pushed again, the first spring 11 pushes the center of the bimetallic plate 15 upward which contacts the projections 100 on an inside of the base 10 and the two ends of the bimetallic plate 15 is bent downward again. If the user pushes the button 252 again, the bimetallic plate 15 is moved as shown in FIG. 4 to connect the circuit.

The safety switch needs only one button assembly 25 and the bimetallic plate 15 is deformed when overflow. The safety switch requires a simple structure and this reduces the manufacturing cost and the response time is shorter than the conventional switches.

While we have shown and described the embodiment in accordance with the present invention, it should be clear to those skilled in the art that further embodiments may be made without departing from the scope of the present invention.

What is claimed is:

1. A safety switch comprising:

a base having two terminals connected thereto and each terminal having a first contact point;

a bimetallic plate movably received in the base and two second contact points connected to two ends of the bimetallic plate, the two second contact points located above the two first contact points and the two ends of the bimetallic plate being bent when overflow;

a first spring biased between an inside of the base and the bimetallic plate, and a button assembly connected to the base and a second spring biased between the button assembly and the bimetallic plate.

2. The safety switch as claimed in claim 1, wherein the bimetallic plate is supported on a support post at a center of the bimetallic plate and the first spring is biased between an inside of the base and a lower end of the support post.

3. The safety switch as claimed in claim 2, wherein the bimetallic plate has a hole defined through a center thereof and a top end of the support post extends through the hole and is connected to a cap, the second spring is biased between the cap and the button assembly.

* * * * *